United States Patent [19]

Bongort

[11] 4,152,563

[45] May 1, 1979

[54] PUSH-BUTTON REVERSING SWITCH

[75] Inventor: Edgar A. Bongort, Southfield, Mich.

[73] Assignee: B/W Controls, Inc., Birmingham, Mich.

[21] Appl. No.: 745,669

[22] Filed: Nov. 29, 1976

[51] Int. Cl.[2] ..... H01H 21/10

[52] U.S. Cl. ..... 200/157; 200/1 B; 200/67 DA; 200/153 K; 200/283

[58] Field of Search ..... 200/1 A, 1 B, 153 K, 200/283, 339, 302, 67 D, 67 DA, 157

[56] References Cited

U.S. PATENT DOCUMENTS

| | | | |
|---|---|---|---|
| 2,314,465 | 3/1943 | Shaw | 200/1 A |
| 2,783,317 | 2/1957 | Eckles | 200/283 X |
| 2,866,030 | 12/1958 | Wirth, Jr. | 200/1 A X |
| 3,015,002 | 12/1961 | Laviana | 200/283 |
| 3,654,415 | 4/1972 | Hawkins | 200/302 |

FOREIGN PATENT DOCUMENTS

| | | | |
|---|---|---|---|
| 1115822 | 4/1956 | France | 200/1 B |
| 2007830 | 1/1970 | France | 200/67 D |
| 85134 | 5/1920 | Switzerland | 200/1 B |

*Primary Examiner*—Harold J. Tudor

*Attorney, Agent, or Firm*—Burton, Parker & Schramm

[57] ABSTRACT

A momentary contact, push-button type reversing switch has a manual actuator which, upon depression, effects sequential contact closing of a plurality of contacts and which, upon release, effects sequential contact opening, the contacts including a plurality of pairs of spaced apart contacts with elongated reed-like movable contacts normally centered between the stationary contacts and operatively associated with a spring-centered yoke assembly with opposite ends of which the manual actuator cooperates for shifting the yoke.

9 Claims, 11 Drawing Figures

PUSH-BUTTON REVERSING SWITCH

FIELD OF INVENTION

This invention relates to push-button type reversing switches of the momentary contact type which will sequentially close a plurality of contacts upon depression of a button and sequentially open the contacts upon release of the button.

BACKGROUND OF THE INVENTION

This invention stems from the desire to improve pendant controls for overhead hoists. Pendant controls normally are provided with "up and down" control functions enabling the operator to raise and lower the hoist. By pushing one or the other of two buttons and holding the button depressed, the operator is able to move the hoist in one or the other direction, while upon release of the button movement of the hoist is stopped. A brake may be provided which upon energization is released during operation of the hoist motor. Such controls are shown in U.S. Pat. Nos. 3,654,415 and 3,126,467. Because of the adverse environment in which such controls are often used and the abuse to which they may be subjected, it is desirable that the switch be effectively sealed against the ingress of moisture and dirt and be of rugged and foolproof construction. In addition, they should be of low cost while not sacrificing reliability.

SUMMARY OF THE INVENTION

I have discovered that fabricational costs may be reduced and improved reliability obtained with a new design for a push-button switch, particularly, though not exclusively, suited for use in a pendant hoist control. Primarily, the invention involves improvements in the switch mechanism itself simplifying the design and eliminating actuating parts while at the same time enabling its use in a casing which will not only protect the switch mechanism but also prevent the ingress of moisture and dirt.

In carrying out the invention, I provide a switch assembly having a plurality of pairs of spaced apart fixed contacts, the number of pairs corresponding to the number of circuits to be controlled. Between the contacts of each pair I disposed the free end of a reed-like movable contact, the opposite end of the reed being fixed at some distance from the fixed contacts. Between opposite ends of the reed-like contacts I provide a pivoted yoke which cooperates with the reeds to flex them into abutment with one or the other of the fixed contacts of each pair depending upon the direction of pivotal movement of the yoke. The switch assembly may be enclosed within a housing having the yoke disposed opposite a push-button type actuator operable through an opening in the housing with a diaphragm closing the opening and extending between the actuator and switch. The fixed contacts are preferably arranged such that they are sequentially closed and opened upon flexing of the movable contacts. While the reeds are normally disposed out of abutment between the fixed contacts, the yoke itself is spring centered to insure neutrality of the reeds.

BRIEF DESCRIPTION OF PREFERRED EMBODIMENT

Figure 1:
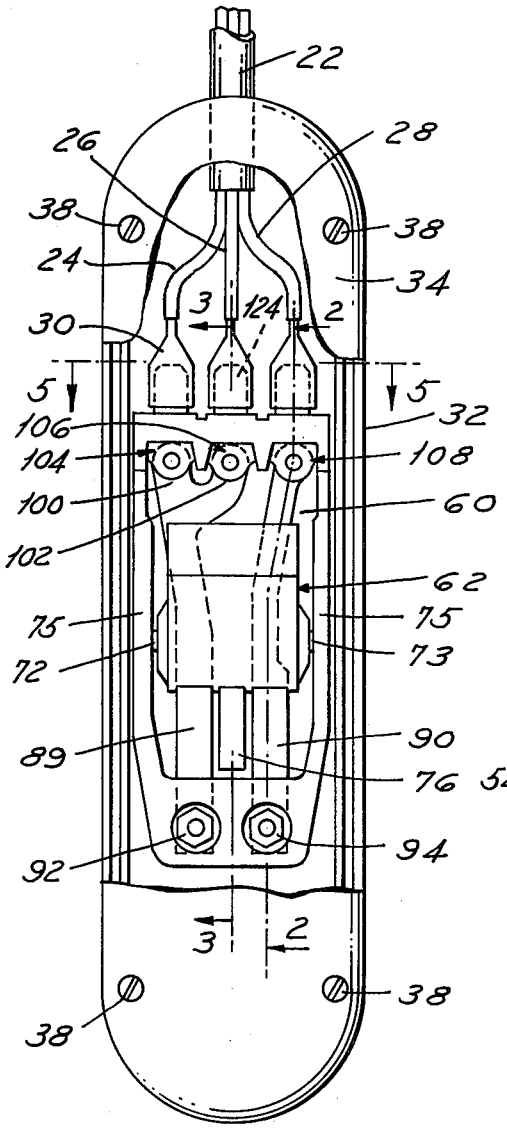
FIG. 1 is a plan view partially in section showing a pendant hoist control embodying my invention.

As shown in the drawings, the invention is embodied in a hoist control pendant switch having a protective casing 20 which is suspended from the hoist by an electrically conductive cable 22 which may contain a plurality of electric conductors, three being shown at 24, 26 and 28, with each terminating in a female socket as shown at 30 in FIG. 1. The sockets are intended to be telescoped over projecting blade type male terminals in gripping engagement therewith to complete circuits to the switch as hereinafter explained. The number of the conductors will depend upon the device to be controlled as will be understood by those skilled in the art.

The casing 20 may be of any desired exterior configuration, and the invention disclosed herein is not intended to be limited to any particular exterior configuration of the casing. In a pendant hoist control device, the casing is normally intended to be hand held by the hoist operator with his thumb overlying a side of the casing to operate switch mechanism contained therewithin. The casing preferably comprises two mating halves, a back half 32 and a front half 34. At the parting line between the casing halves is disposed a gasket of neoprene or other suitable flexible material 36 which is squeezed between the casing halves to seal the casing by a plurality of threaded fasteners 38 extending through the front casing half and threaded into the back casing half.

The casing defines internally a cavity 40. The front casing half 34 is shaped to define an opening 42 which is adapted to receive a pivotally supported rocker arm actuator 44 supported on an axle 46 mounted in the upper casing half 34 in any suitable fashion. The rocker arm actuator includes a pair of longitudinally spaced thumb engaging push button portions 48 and 50, which may be engaged by the operator's thumb for selective depression and consequent rocking of the actuator about the axle 46.

The gasket 36 includes a diaphragm portion 52 which bridges across the opening 42 beneath the actuator 44 to seal the bottom of the opening and also seal the cavity 40 within the casing. The diaphragm 52 may be provided with a pair of longitudinally spaced integral bosses 54 and 56 disposed beneath the button portions 48 and 50 of the rocker arm 44 for purposes of engaging the switch mechanism hereinafter described for shifting the same upon rocking of the actuator.

Figure 3:
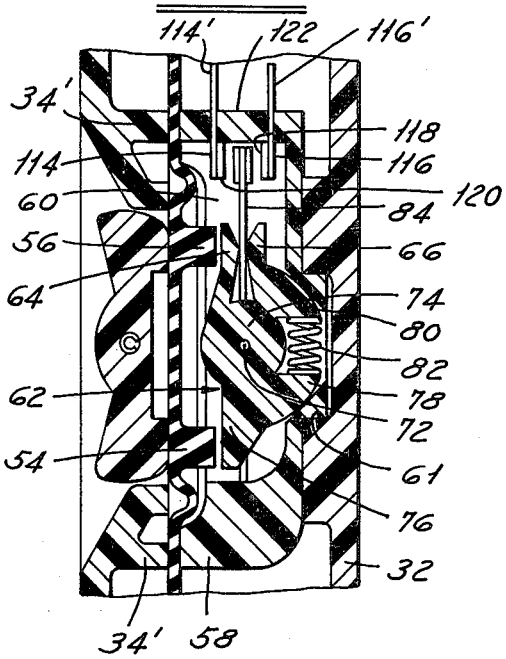
FIG. 3 is a cross-sectional view taken substantially on the Line 3—3 of FIG. 1.
Figure 9:
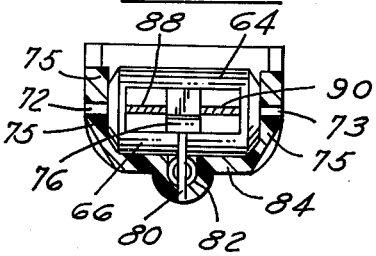
FIG. 9 is a cross-sectional view taken on the Line 9—9 of FIG. 8.

Within the cavity 40 of the casing and in particular within the back portion 32 is disposed a switch assembly. The switch assembly comprises a housing 58 shown in FIGS. 4, 9 and 11 which preferably is a separate element from the back casing half 32 and is seated thereagainst with a back wall portion 84' nested in a complementary recess 61 (See FIG. 3) in the back of casing half 32. Portions 34' of the front casing half 34 squeeze the diaphragm portion 52 of the gasket 36 against the front edge of the switch housing 58 as shown in FIG. 3 to hold the housing in the recess 61 against shifting.

Figure 4:
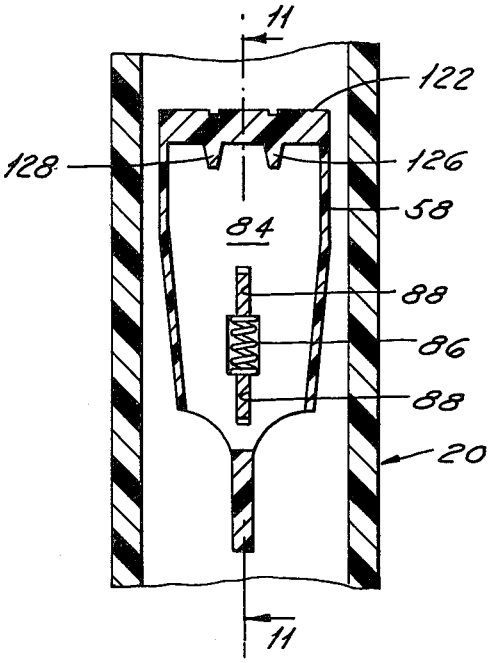
FIG. 4 is a cross-sectional view taken substantially on the Line 4—4 of FIG. 2.
Figure 11:
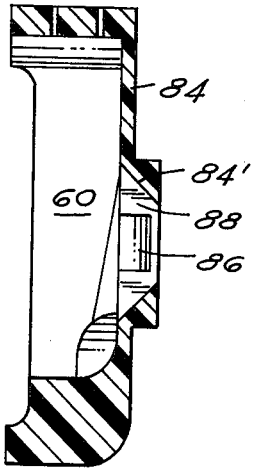
FIG. 11 is a cross sectional side view of the switch housing with parts removed for clarity taken on the Line 11—11 of FIG. 4 or Line 3—3 of FIG. 1.

The housing 58 is shaped as shown in the various figures of the drawing to provide an outwardly opening cavity 60 within which is pivotally supported a yoke member 62 having a pair of longitudinally extending generally parallel spaced apart arms 64 and 66. The arms are laterally connected together by side wall portions 68 and 70 which provide pivot pin bearing holes for receiving pivot pins 72 and 73 which extend transversely of the arms and are carried by the opposed side walls 75 of the switch housing. Intermediate the side walls the arms 64 and 66 are joined by an integral longitudinal portion 74 having an extension 76 projecting in the opposite direction from the arms for underlying the boss 54 of the diaphragm. The bottom of the yoke is shaped to define a pair of thin blade like projections 78 and 80 defining therebetween a spring receiving notch 80' within which is disposed a coil compression spring 82. The back wall portion 84' of the switch housing as shown in FIGS. 4 and 11 is provided with a narrow slit 88 which is enlarged intermediate its ends by a rectangular pocket 86. Those portions of the slit 88 extending beyond opposite ends of the pocket form narrow extensions of the pocket opening. With the yoke mounted in the housing, the projections 78 and 80 thereof extend into the slit 88 and the spring 82 is disposed within the rectangular pocket 86. As a consequence, the spring will bear against opposite ends of the pocket and serve to center the yoke and hold it in the position shown in FIG. 3. Thus, the yoke is self-centering.

Figure 2:
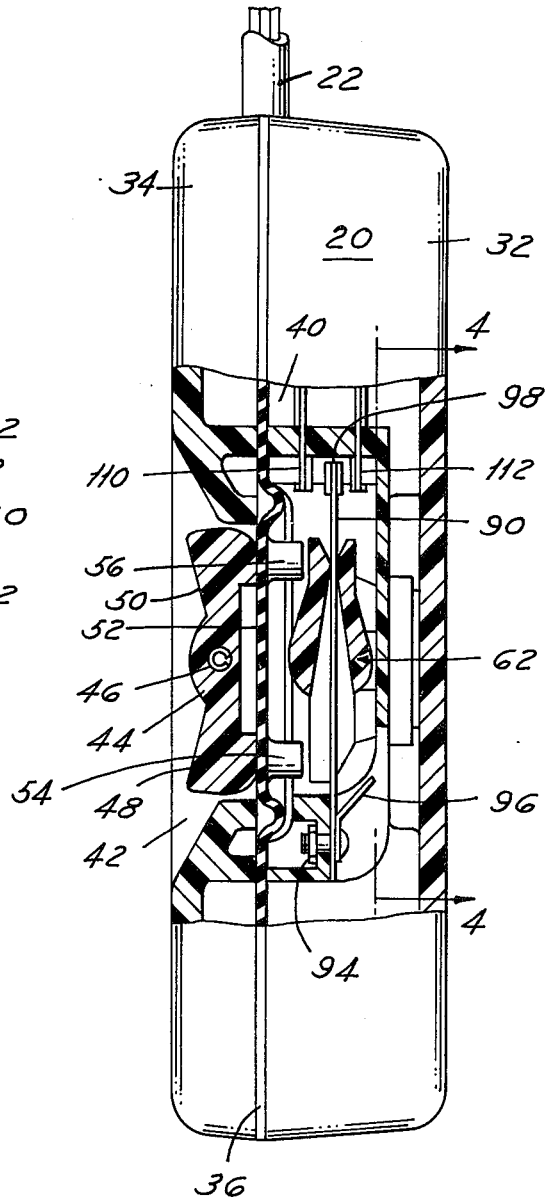
FIG. 2 is a side elevation of the control shown in FIG. 1 partially in section taken along the Line 2—2 of FIG. 1.
Figure 7:
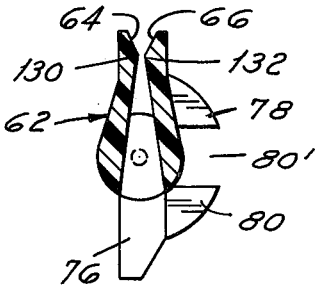
FIG. 7 is a cross-sectional view taken substantially on the Line 7—7 of FIG. 6.
Figure 8:
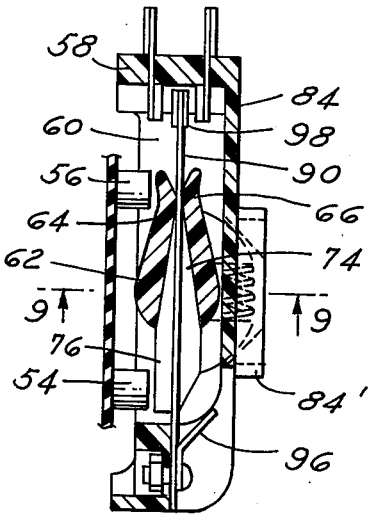
FIG. 8 is a cross-sectional side view through the switch housing taken on the Line 2—2 of FIG. 1 the housing being removed from the outer casing and with the spring centering mechanism being shown.
Figure 10:
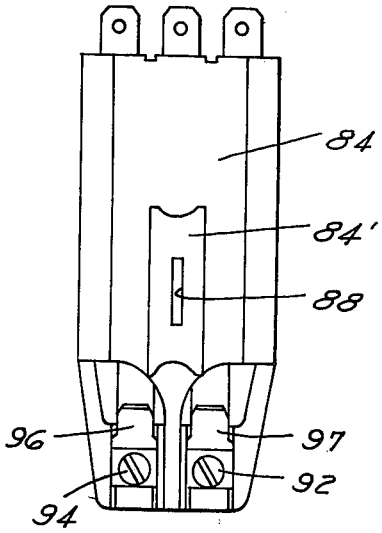
FIG. 10 is a back view of the switch housing of FIG. 8.

Disposed within the switch housing 58 are a plurality of resilient elongated electrically conductive movable contacts in the form of reeds 89 and 90. The reeds are fixedly mounted at one end in the housing as shown in FIGS. 1, 2 and 8 by small screws having nuts threaded thereon, the same being generally indicated at 92 and 94. Beneath the heads of the screws 92 and 94 are disposed male electric blade type terminals, as shown at 96 and 97 in FIGS. 2, 8 and 10. The terminals as thus shown are in contact with the associated reeds 89 and 90. The reeds extend freely through the longitudinal openings between the spaced arms 64 and 66 of the yoke with the free ends disposed in normal condition as shown in FIGS. 2, 3 and 8. The free ends of the reeds may be provided with suitable electric contact buttons 98 on opposite faces. The arms 64 and 66 of the yoke have inner opposed ridges 130 and 132 as shown in FIG. 7 such that upon rocking motion of the yoke induced by depression of either of the push button portions of the manual actuator 44, the yoke will smoothly deflect the reeds in one direction or the other.

As shown in FIG. 1, reed 89 is provided with a bifurcated end having laterally spaced contact portions 100 and 102 each of which is provided with contact buttons. Thus, at the free ends of the reeds 89 and 90 there appear three free end portions each having contact buttons. Such free end portions are normally disposed in spaced relation between and out of engagement with pairs of fixed contacts as shown in FIGS. 2, 3 and 8. Such fixed contacts are grouped in three pairs 104, 106 and 108 as shown in FIG. 1. The contacts of pair 108 are shown in FIG. 2 at 110 and 112 while those of pair 106 are shown in FIG. 3 at 114 and 116. The fixed contacts of pair 104 are similarly arranged as the contacts for pairs 106 and 108. As shown in FIG. 3 the fixed contacts have contact buttons 118 and 120 on those faces opposed to the contact reed buttons. The fixed contacts extend through an end wall 122 of the switch housing with an end portion, such as end portion 114' and 116' projecting, in each instance, therebeyond and providing male blade type terminals for attachment of the female terminal sockets 30 as shown in FIG. 1. The end wall 122 of the switch housing may be shaped to provide barriers or separators 126 and 128 as best shown in FIG. 4 which tend to isolate the fixed contacts and the reed ends of adjacent pairs from one another thereby preventing tendency of arcing across between the contacts of adjacent pairs.

Figure 5:
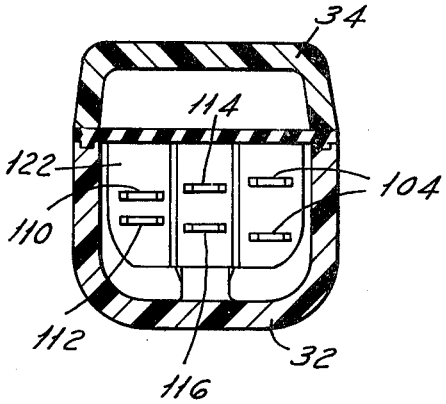
FIG. 5 is a cross-sectional view taken substantially on the Line 5—5 of FIG. 1; and showing the terminal ends of the fixed contacts with the female sockets of the lead wires removed for clarity.
Figure 6:
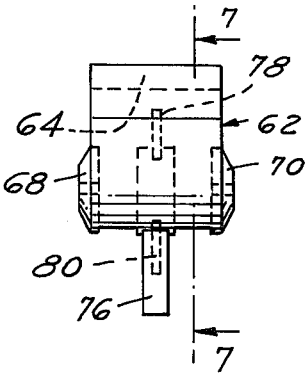
FIG. 6 is a plan view of the yoke assembly.

The fixed contacts of the pairs 104, 106 and 108 are spaced apart different distances as shown in FIG. 5 where the contacts 110 and 112 are closest together while 114 and 116 are spaced further apart and the contacts of pair 104 are spaced the furthest apart. As a consequence of this, upon flexing the reeds the free end of reed 90 will engage the fixed contacts of pair 108 before end portion 102 of reed 89 engages the fixed contacts of pair 106 and the end portion 100 of reed 89 will engage the contacts of pair 104 last. Therefore, upon pivotal movement of the rocker 62, circuits are completed successively between the reed ends and the fixed contacts. This is possible because of the flexible character of the resilient reeds enabling the rocker arm to flex them into engagement with the fixed contacts. In the case of reed 89, the bifurcated end will twist slightly to enable the end portions 100 and 102 to successively engage the fixed contacts. As a consequence, circuits are both made successively and opened successively during rocking motion of the rocker arm. This is of value in the control of overhead hoists and related mechanisms as it permits setting up the directional portion of the motor circuit before closing the last contact which completes the electrical circuit energizing the motor and brake simultaneously. This is important in the control of a single phase hoist motor to prevent a loaded hoist from running down when the up button is pushed.

The spring means 82 serving to render the yoke self-centering holds the yoke in a position maintaining the movable contact reeds centered between the fixed contacts and out of engagement therewith. Also, by virtue of the flexing action of the reeds, there is a wiping action between the contact buttons of the reeds and fixed contacts.

As shown in the drawings, six fixed contacts and their respective terminal ends are provided, as well as terminals 96 and 97 at the fixed ends of the reeds. These terminals may be connected as desired to electric leads entering the casing as by way of the conductive cable 22 to provide a circuit arrangement as desired by the circuit designer. While two reeds and three movable contacts are shown, it will be understood by those skilled in the art that both reeds may have bifurcated ends such as the reed 88, or both reeds may have a single end as reed 90, or that a greater or lesser number of reeds may be provided as desired.

What is claimed is:

1. A control device comprising:

a casing having a cavity therein and having an opening in communication with the cavity, flexible diaphragm means for sealing said opening and cooperating with the casing to define said cavity, manually operated rocker arm means arranged exteriorally of said casing for pivotal movement between switch operating positions, said rocker arm means being disposed adjacent said opening for engagement with said diaphragm means, and said rocker arm means being arranged for engagement by the thumb of the hand of a user gripping the casing, a plurality of pairs of spaced apart fixed contacts in the cavity disposed in stepped relation, a plurality of elongated resilient conductive reeds in the cavity having one end fixedly supported and the opposite end extending between but spaced from the fixed contacts of each pair, yoke means embracing the reeds intermediate their opposite ends and pivotally supported in the cavity opposite said opening and adjacent the diaphragm means for shifting the reeds uniformly with the yoke means so they smoothly deflect into engagement with the fixed contacts in response to the rocker arms means induced movement of the diaphragm, and said reeds extending through and beyond the yoke means to provide end portions which engage and disengage the fixed contacts successively as the reeds are shifted theretowards and therefrom, the end portions which first engage contacts resiliently flexible to allow engagement by the other end portions upon further movement of the diaphragm.

2. The invention defined by claim 1 wherein spring means are provided for centering the yoke means from either direction of its pivotal movement with the centered position holding the reeds out of engagement with the fixed contacts.

3. A control device comprising:

a casing having a cavity therein and having an opening in communication with the cavity, flexible diaphragm means for sealing said opening and cooperating with the casing to define said cavity, a plurality of pairs of spaced apart fixed contacts in the cavity disposed in stepped relation;

a plurality of elongated resilient conductive reeds in the cavity having one end fixedly supported and the opposite end extending between but spaced from the fixed contacts of each pair, yoke means embracing the reeds intermediate their opposite ends and pivotally supported in the cavity opposite said opening and adjacent the diaphragm means for shifting the reeds uniformly with the yoke means so they smoothly deflect into engagement with one or the other of the fixed contacts of each pair in response to diaphragm induced movement of the yoke means;

said reeds extending through and beyond the yoke means to provide end portions which engage and disengage the contacts successively as the reeds are shifted theretowards and therefrom, the end portions which first engage contacts resiliently flexible to allow successive engagement by the other end portions upon further movement of the yoke means; and manual actuating means for depressing the diaphragm means to pivot the yoke.

4. The invention defined by claim 3 wherein spring means are provided for centering the yoke means from either direction of its pivotal movement with the centered position holding the reeds out of engagement with the fixed contacts.

5. A momentary contact reversing switch assembly comprising:

a housing defining a cavity, a plurality of elongated resilient conductive reeds in the cavity fixedly supported at one end for flexing transversely of their length, a plurality of pairs of fixed contacts in the cavity arranged on opposite sides of the free ends of the reeds in spaced stepped relation therefrom when the reeds are in an unflexed state, a yoke pivotally supported in the cavity for rockable movement, said yoke having portions embracing each reed intermediate their opposite ends to successively shift the reed against one or the other of the fixed contacts of each pair upon rocking of the yoke in one direction or the other, said reeds extending through and beyond the yoke means to provide end portions which flex against the contacts during said rocking of the yoke, spring biasing means engaging the yoke for yieldingly holding the same in a position disposing the free ends of the reeds in spaced relation from the fixed contacts, diaphragm means for closing said cavity, and manual actuating means for depressing the diaphragm means to pivot the yoke.

6. The invention defined by claim 5 wherein said yoke has a body portion defining a pair of longitudinally extending spaced apart arms adapted to overlie opposite sides of said reeds with the reeds extending freely completely through the yoke.

7. The invention defined by claim 5 wherein said spring biasing means comprises a pocket in said housing opening into the cavity, a compression spring disposed in said pocket with opposite ends of the spring abutting opposite ends of the pocket, said housing defining a slot at each end of said pocket opening into the pocket and into the cavity and forming an extension of the pocket, said slot having a width less than that of the pocket whereby the compression spring bridges across the slot, and said yoke having a pair of blade like projections spaced apart to embrace opposite ends of the spring and extending into the slots, whereby pivoting of the yoke in either direction will compress the spring and return the yoke to a centered position.

8. A control device comprising a casing having a cavity therein and having an opening in communication with the cavity, flexible diaphragm means for sealing said opening and cooperating with the casing to define said cavity, means supported in the casing exteriorally thereof and opposite the diaphragm for manual actuation to depress longitudinally spaced apart portions of the diaphragm, yoke means within the cavity opposite the diaphragm supported for pivotal movement about a transverse axis in response to engagement by depression of said longitudinally spaced portions of the diaphragm, said yoke means having a longitudinally extending aperture opening outwardly through opposite ends, a plurality of conductive reeds extending completely through said aperture and fixedly supported at one end in the casing, pairs of spaced apart fixed contacts with each pair a different spaced apart distance supported on the casing and embracing the opposite non-fixedly supported ends of the reeds in spaced relation therefrom and adapted to be engaged thereby upon pivotal movement of the yoke means;

the reeds having their nonfixedly supported ends moving with the yoke means during its pivotal movement while the ends are between contacts but flexing against the contacts after engagement; and the non-fixedly supported ends of at least one reed engaging one of the fixed contacts of one pair before another such end engages one of the fixed contacts of another pair during pivotal movement of the yoke.

9. The invention defined by claim 8 wherein self-centering spring means are provided in the cavity for engaging the yoke means and yieldably biasing it to a neutral position wherein the reeds are disposed out of engagement with the fixed contacts.

* * * * *